United States Patent [19]

Whitney

[11] Patent Number: 4,551,869

[45] Date of Patent: Nov. 12, 1985

[54] FLOOR SUPPORT FOR A BATHTUB

[75] Inventor: Thomas H. Whitney, Attica, Mich.

[73] Assignee: Trayco Inc., Lapeer, Mich.

[21] Appl. No.: 591,469

[22] Filed: Mar. 20, 1984

[51] Int. Cl.[4] ..... A47K 3/00; A47K 3/16; A47K 3/02; A47K 3/022

[52] U.S. Cl. ..... 4/592; 4/589; 4/593; 4/594; 4/595

[58] Field of Search ..... 4/592, 594, 595, 589

[56] References Cited

U.S. PATENT DOCUMENTS

| | | | |
|---|---|---|---|
| 2,697,231 | 12/1954 | Strand | 4/595 |
| 3,088,124 | 5/1963 | Long | 4/593 |
| 3,359,574 | 12/1967 | Stoneburner | 4/592 |
| 3,561,019 | 2/1971 | Roland | 4/593 |
| 3,605,352 | 9/1971 | Ruggles et al. | 4/592 |

*Primary Examiner*—Henry K. Artis

*Attorney, Agent, or Firm*—Steven L. Permut; Malcolm L. Sutherland; Leon E. Redman

[57] ABSTRACT

A floor support for a plastic bathtub has a top panel and integral ribs injected molded from PVC plastic. The panel has an upper contoured surface which matches the contour of the underside surface of the plastic bathtub. The depending support ribs provide for structural support and for seating legs which elevate the support above floor level. The top panel has a drain support section with an aperture therethrough to align with the aperture through the floor of the bathtub and provides a seat for the drain pipe. The floor support is solvent welded to the underside of the plastic bathtub to provide for a durable, rigid and lightweight tub.

8 Claims, 5 Drawing Figures

Fig. 1.
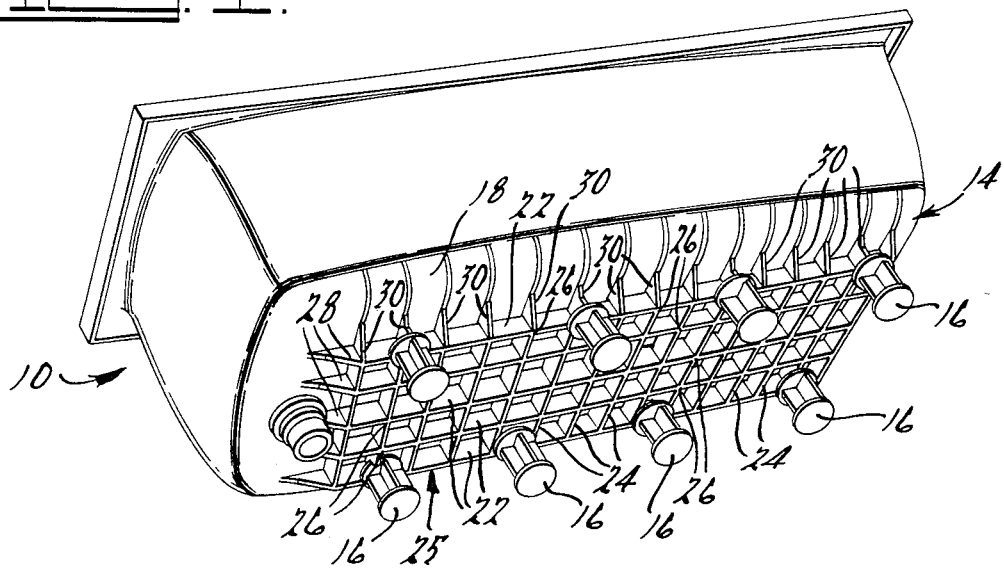
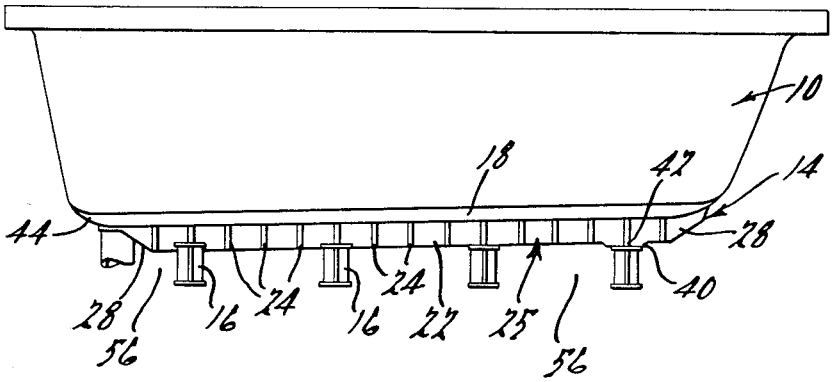
Fig. 2.
Fig. 3.
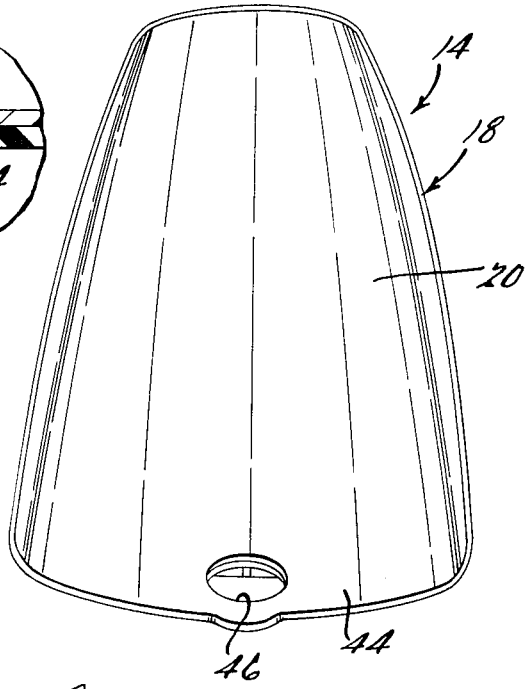
Fig. 5.
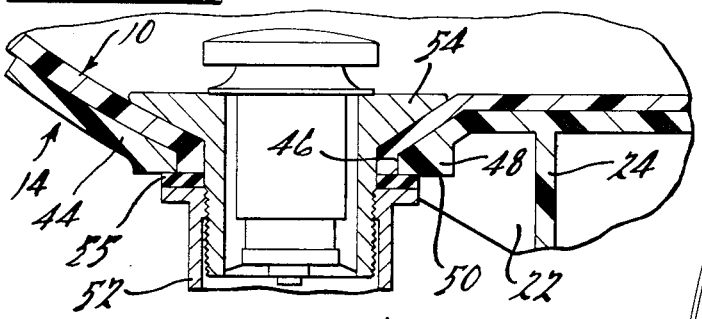
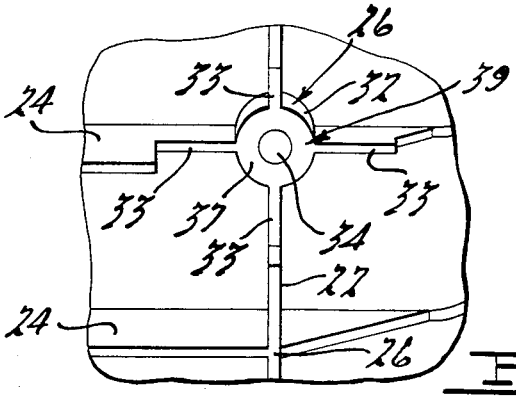
Fig. 4.

FLOOR SUPPORT FOR A BATHTUB

TECHNICAL FIELD

This invention relates to plastic bathtubs and more particularly, to a plastic bathtub floor having a support member thereunder.

DISCLOSURE INFORMATION

Plastic bathtubs are becoming increasingly popular. Housing manufacturers are installing plastic bathtubs rather than ceramic or fiberglass bathtubs. Plastic bathtubs are easier to manufacture, easier to ship, easier to handle, and easier to install than ceramic or fiberglass bathtubs. Plastic bathtubs, however, are sometimes perceived to be an undesirable substitute for ceramic bathtubs in that they are made from plastic. Plastic materials often are unjustly perceived as being less durable and as having a shorter life expectancy than the materials which it replaced.

For plastic bathtubs, a strong solid feeling floor is essential otherwise people would not accept the plastic bathtub. The give in the floor through a period of time may also decrease the life expectancy of the tub if the plastic hardens as it ages. The flexing can cause the plastic to snap and eventually a replacement tub would be necessary.

Consequently, plastic bathtubs have been made with reinforced floors. The reinforcement is usually provided by a support member connected to the underside of the bathtub floor. The conventional floor supports include a rigid particle board with a layer of urethane foam and a styrene liner sandwiched between the particle board and the underside of the bathtub floor. The particle board can have holes drilled therein to receive legs which raise the tub above the floor to provide a space for pipes, plumbing, and easy access to the drain.

The bonding of the styrene liner to the underside of the bathtub, the forming of the urethane foam layer and bonding of the particle board to the urethane are labor intensive steps that require a large amount of time and factory space. In addition, the particle board is relatively heavy and adds significant shipping weight to the plastic bathtub.

What is needed is a lightweight floor support that is easily manufactured and easily secured to the plastic bathtub.

SUMMARY OF THE INVENTION

In accorcance with the invention, the floor support for a plastic bathtub includes a top rigid panel having an upper side contoured to fit on the bottom side of the bathtub floor. A plurality of ribs are integrally formed with the top panel and depend from the top panel.

Preferrably, the plurality of ribs include a first set of ribs running essentially longitudinal along the length of the bathtub and a second set of ribs extending substantially along the width of the bathtub. The plurality of ribs criss-cross to form a lattice.

In one embodiment, the base support has a forward drain support section having an aperture therethrough aligned with the aperture through the bathtub floor. The drain support section has a flat annular rim surrounding the aperture for sealingly seating the drain pipe thereagainst.

In one embodiment of the invention, the support member has leg receiving means for receiving a plurality of legs which position the support member and the plastic bathtub above floor level to form a clearance thereunder for receiving plumbing and providing access to the drain pipe.

BRIEF DESCRIPTION OF THE DRAWINGS

Reference now will be made to the accompanying drawings in which:

FIG. 1 is a bottom perspective view of the plastic bathtub and floor support according to the invention;

FIG. 2 is a side elevational view of the plastic bathtub and floor support shown in FIG. 1;

FIG. 3 is a top perspective view of the floor support member;

FIG. 4 is an enlarged fragmentary view showing a leg connected to a portion of the support; and FIG. 5 is an enlarged side elevational view showing the drain support section.

DETAILED DESCRIPTION OF THE PREFERRED EMBODIMENT

A plastic bathtub 10 has a contoured floor 12. A floor support 14 is secured to the underside of the floor 12. The support 14 is elevated above floor level by a plurality of legs 16. The bathtub can be vacuum formed from PVC plastic. The floor support 14 can be injected molded from PVC plastic or A.B.S. plastic.

The floor support has an upper panel section 18 with an upper surface 20 as shown in FIG. 3 contoured to the particular underside of the floor of the plastic bathtub 10. The floor support 14 can be solvent welded to the bathtub 10. The solvent cement that is used for solvent welding the plastic bathtub can be laid in strips or in a criss-cross pattern. Suitable solvent cements are Oatey or Genova-weld.

Depending from the panels 18, are a first set of longitudinally extending ribs 22 and a second set of ribs 24 extending width-wise across the plastic bathtub. The ribs 22 and 24 intersect at plurality of intersections 26 to form a lattice 25. Each rib has tapered ends 28 or 30. The lattice 25 includes, as shown in FIG. 5, an annular cylindrical wall 32 having a hole 34 therein which is adapted to receive a retaining knob (not shown) of leg 16. The wall 32 is located at the intersection 26 of ribs 22 and 24.

The ribs 22 and 24 can be shortened about the wall member 32 such that its bottom edge 33 coincides with the bottom 37 of wall 32 to form a seat 39 for the legs 16. As shown in FIG. 2, the front two pairs of legs abut a recessed edge of the ribs 22 and 24. The recess is more particularly shown in FIG. 4. Contrarily, the ribs 22 and 24 can have depending downward extensions 40 and 42 to form a seat for the rear legs as shown in FIG. 2. The differing height of seats along the length of the floor support provides for the proper inclination of the tub.

The front portion of the panel includes a drain support section 44 as more clearly shown in FIG. 4. The drain support section has hole 46 therethrough. An annular flange 48 surrounds hole 46 and has a flat lower surface 50 to provide a seat for the drain pipe 52 and its gasket member 55. The drain pipe 52 and gasket is connected to a drain stopper sleeve 54 in a conventional manner through the hole 46.

The plastic injected molded floor support provides for a lightweight, inexpensive and durable suport for the plastic bathtubs. This plastic support gives the plastic tub the needed rigidity to commercially compete with ceramic and fiberglass tubs. In addition, the extra rigidity increases the life expectancy of the plastic bathtub.

Furthermore, the plastic injected molded bath support allows for the insertion of legs which raises the bathtub above floor level to provide for an access clearance 56 underneath the tub.

The plastic support is made with a reduced amount of hand labor and can be easily secured to the plastic tub without the use of special liners or special cushioning devices.

Variations and modifications of the present invention are possible without departing from the scope and spirit as defined in the appended claims.

The embodiments of the invention in which an exclusive property or privilege is claimed are defined as follows:

1. A base support for a plastic bathtub comprising:

a panel section with a top contoured surface shaped to abut the underside of a plastic bathtub;

a first set of substantially parallel ribs integrally formed with said panel section and depending downwardly therefrom;

a second set of substantially parallel ribs integrally formed with said panel section and depending downwardly therefrom;

said second set intersecting said first set at a plurality of intersections; and a plurality of said intersections having an annular cylindrical wall defining a respective recess therein for receiving a respective support leg.

2. A base support as defined in claim 1 wherein at a plurality of intersections of said ribs an annular recess is formed to receive base legs therein.

3. A base support as defined in claim 2 wherein the cylindrical wall and the ribs thereabout form a seat for the legs to prevent them from pivotal motion about an axis transverse to their longitudinal axis.

4. A base support as defined in claim 3 wherein;

a front pair of said seats is raised with respect to the bottom edge of the ribs, a rear pair of seats is lower than the bottom edge of said ribs, each rib forming said rear seats has a downwardly extending projection integral with said ribs extending downwardly to coalign with a bottom edge of said cylindrical wall.

5. A base support as defined in claim 1 further comprising;

a forward drain support section having an aperture therethrough aligned with an aperture through said bathtub; said drain support section having a flat annular rim surrounding said aperture for sealingly seating a drain pipe thereagainst.

6. A base support for a plastic bathtub comprising; a top panel having one side contoured to fit on the underside of said bathtub;

a plurality of integrally formed ribs depending from an opposite side of said top panel;

a forward drain support section having an aperture therethrough aligned with an aperture through said bathtub; said drain support section having a flat annular rim surrounding said aperture for sealingly seating a drain pipe thereagainst.

7. A base support for a plastic bathtub comprising;

a top panel having one side contoured to fit on an underside floor section of said bathtub;

said one side fitted to abut the entire underside floor section of said bathtub and a plurality of integrally formed ribs depending from an opposite side of said top panel and wherein said plurality of ribs crisscross each other to form a support lattice depending from said top panel.

8. A base support for a plastic bathtub comprising;

a top panel having one side contoured to fit on the under-side of said bathtub;

a plurality of integrally formed ribs depending from an opposite side of said top panel;

a forward drain support section having an aperture therethrough aligned with an aperture through said bathtub; said drain support section having a flat annular rim surrounding said aperture for sealingly seating a drain pipe thereagainst.

* * * * *